United States Patent [19]

Rautenbach, deceased et al.

[11] 4,334,799

[45] Jun. 15, 1982

[54] IMPACT ROLLER

[76] Inventors: Jacobus J. Rautenbach, deceased, late of Krugersdorp, South Africa; by Aletta C. Rautenbach, executrix, 3 Cecil Knights St., Kruggrsdorp 1740 Transvaal Province, South Africa

[21] Appl. No.: 123,596

[22] Filed: Feb. 22, 1980

[30] Foreign Application Priority Data

Feb. 22, 1979 [ZA] South Africa ..... 79/0850

[51] Int. Cl.[3] ..... E01C 19/28; E01C 23/12

[52] U.S. Cl. ..... 404/124; 172/545; 404/90; 404/117

[58] Field of Search ..... 404/124, 117, 90, 75, 404/130; 172/45, 91, 545; 305/4; 301/48

[56] References Cited

U.S. PATENT DOCUMENTS

| | | | |
|---|---|---|---|
| 287,479 | 10/1883 | Smith | 172/45 |
| 1,450,173 | 4/1923 | Frickey | 172/45 |
| 1,459,568 | 6/1923 | Blum | 172/45 |
| 1,698,451 | 1/1929 | Rasmussen | 172/545 X |
| 2,335,372 | 11/1943 | Wine | 305/4 |
| 2,606,011 | 8/1951 | Lommen | 172/45 X |
| 2,909,106 | 10/1959 | Berrange | 404/124 |
| 3,025,067 | 3/1962 | Raney et al. | 275/6 |
| 3,788,757 | 1/1974 | Berrange | 404/124 |
| 3,885,632 | 5/1975 | Lely | 172/68 |

FOREIGN PATENT DOCUMENTS

| | | | |
|---|---|---|---|
| 47225 | 4/1911 | Austria . | |
| 224667 | 7/1910 | Fed. Rep. of Germany . | |
| 838962 | 5/1952 | Fed. Rep. of Germany | 172/545 |
| 954051 | 12/1949 | France | 404/130 |
| 1033353 | 7/1953 | France | 404/117 |

*Primary Examiner*—Rodney M. Bonck
*Attorney, Agent, or Firm*—Karl W. Flocks

[57] ABSTRACT

An impact roller for applying blows cyclically to a surface over which the roller is rolling. The roller has flail members pivotally connected thereto and also has recesses to accommodate the flail members when inoperative. In operation, when the roller rolls along a surface, the flail members fall forwardly under gravity and impart cyclic downward blows to the surface over which the roller is rolling. Upon faster rolling of the roller, the magnitude of the blows increases under the action of centrifugal force.

11 Claims, 3 Drawing Figures

IMPACT ROLLER

BACKGROUND OF THE INVENTION

1. Field of Invention

This invention relates to impact compaction or slab breaking apparatus. It relates in particular to an impact roller. Such a roller can consolidate or compact soil or earth by impact. It can also break up a hard, brittle layer such as a slab of concrete or concrete paving.

2. Description of the Prior Art

The applicant is aware of impact rollers which consolidate earth by dynamic impact rather than by mere rolling mass. Such rollers are non-circular and provide impact blows in operation. Such rollers, because of variations in the tractive effort, required, have a punishing effect on the draft vehicles pulling them. Shock-absorbing couplings are expensive and not always satisfactory when used between such rollers and their draft vehicles. The impact rollers of which the applicant is aware are described in U.S. Pat. Nos. 2,909,106 and 3,788,757.

It is an object of this invention to provide an impact roller which will not have the same disabilities as the impact rollers known to the applicant.

SUMMARY OF INVENTION

Accordingly, the invention provides an impact roller for applying blows cyclically to a surface over which it is rolling, which comprises a roller assembly adapted to roll along a surface, and which includes a roller body portion; and at least one flail member pivotally connected remote from the impact surface to the roller body portion about an axis parallel to the roller assembly rolling axis and adapted in use while the roller assembly is rolling to have the impact surface impart downward blows to the surface along which the roller assembly is rolling.

A plurality of flail members may be provided, all pivotally connected to the roller body portion in symmetrical circumferentially spaced relationship about axes parallel to the roller rolling axis. Alternatively, or in addition, the flail members may be pivotally connected to the roller body portion in axially and circumferentially spaced relationship about axes parallel to the roller rolling axis. Each flail member may conveniently be shaped to have its mass concentrated towards its free end portion for increasing the flailing impact provided by each flail member during use. The flail members may be mounted in an appropriate staggered relationship to balance the apparatus and to encourage the apparatus to follow a desired path.

In one embodiment of the invention, the roller assembly may have two flail members which are mounted in diametrically opposed relationship on the body portion. In an alternative embodiment of the invention, the roller assembly may have three or four flail members which are mounted at equally spaced circumferential intervals adjacent the periphery of the body portion. The pivotal axis of the or each flail member may be at least half but may be two-thirds or even three-quarters of the roller assembly radius from the roller assembly rolling axis. Conveniently the pivotal axis is provided as close to the roller assembly periphery as possible without disfiguring the roller assembly profile when viewed axially.

The roller assembly may comprise a plurality of roller sub-units mounted in series axial relationship on an axle, each roller sub-unit comprising a pair of axially spaced flanges and at least one flail member pivotally connected between the flanges about an axis parallel to the roller assembly rolling axis. The sub-units may be mounted to be independently rotatable relative to each other about the axis of the axle.

The roller assembly may have recesses to accommodate the flail members when inoperative, within the profile of the roller assembly when viewed in an axial direction.

The or each flail member may have its impact surface profile shaped to conform to the profile of the roller assembly when viewed in an axial direction, and may have a replaceable impact insert providing the impact surface for the flail member.

The roller may have a frame in which the roller body portion is rotatably mounted, and a drawbar for attachment to a draft vehicle. The drawbar may form part of a propelling vehicle or may be adapted for connection to a propelling or draft vehicle. The frame may have means to receive ballast.

The roller may include stop means to limit the displacement arcs of the flail members thereby preventing one flail member in a bank from entering the flail recess of a leading flail member during use.

The roller may also include locking means to lock the flail members to the roller body portion within the profile of the roller assembly when viewed in an axial direction, to permit transfer of the roller from one working zone to another without impact blows during transfer.

The roller may, if desired, include restraining means for restraining pivotal displacement of the flail members during use, towards their operative positions until a sufficient centrifugal force has been generated by rolling of the roller at a sufficient speed. The restraining means may, for example, comprise frictional means operative between the flail recesses and the flail members in the recesses.

While the roller of this invention is particularly suitable for the impact compaction of surfaces, it may also be used for breaking up surfaces. Where the roller is to be used for breaking up surfaces, the impact surfaces of the flail members may have hammer or pick-like projections. For breaking up surfaces, a flail member may have a mass of about 100 kg. But for compaction purposes a flail member may be much heavier and may have a mass of up two tonnes or even more. Thus, the total mass of an impact roller according to the invention may be upwards of twenty tonnes.

An impact roller according to this invention may be made of any desired size, depending upon the surfaces to be treated, upon the capacity of a draught vehicle for propelling the roller, and the degree of compaction required. In an embodiment of the invention, each flail member may be provided with a plurality of mounting bores thereby allowing variation of the flailing action by selecting desired bores for pivotally mounting the flail members on the body portion.

The impact compaction apparatus of this invention may be made of any suitable hard wearing material or materials. The flail members and body portion may conveniently be made of mild steel, or of a suitable surface hardening steel, or manganese steel, or the like. Thus, a flail member may have a suitable seat to accommodate a replaceable insert of high grade wear-resistant material such as manganese steel, and having a hard-wearing impact surface.

The invention extends also to a method of imparting impact blows cyclically to a surface, which includes rolling an impact roller along the surface and allowing at least one mass connected to such roller to fall forwardly under gravity from a recess within the roller profile onto the surface along which the roller is rolling, and thereafter rolling the roller to straddle the mass and allowing the straddled mass to be pulled up by the roller into the recess, upon further rolling of the roller along the surface, so as to be ready for the next cycle of operations.

The invention extends still further to a method of imparting impact blows cyclically to a surface, which includes rolling a roller at speed along the surface and allowing at least one mass connected to the roller to be flung by centrifugal force out of a recess within the roller profile and to have a downward impact blow imparted to the surface while the roller is rolling along the surface, and thereafter rolling the roller to straddle the mass and allowing the straddled mass to be pulled up by the roller into the recess upon further rolling of the roller along the surface, so as to be ready for the next cycle of operations.

An embodiment of the invention is now described by way of example with reference to the accompanying diagrammatic drawings.

DESCRIPTION OF THE PREFERRED EMBODIMENTS

Figure 1:
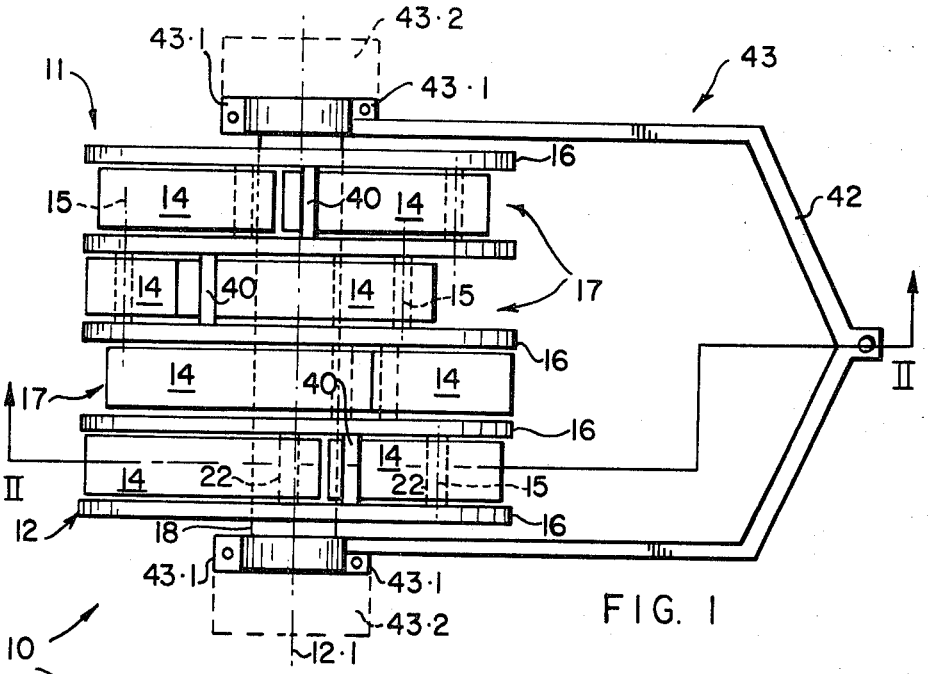
FIG. 1 shows a plan view of one embodiment of an impact roller in accordance with this invention.

With reference to the drawings, reference numeral 10 refers generally to an impact roller adapted to roll along a surface 13 and comprising a roller assembly 11 which includes a body portion 12 and a plurality of flail members 14 which are pivotally mounted on the body portion to exercise a flailing action during displacement of the roller 10. The body portion 12 comprises five circular flanges 16 which are mounted on a shaft 18 in axially spaced relationship. Recesses 17 are defined between the flanges 16 to accommodate the flail members 14.

In the embodiment illustrated in the drawings, the apparatus 10 is intended for use in compacting roadway surfaces, and each flange 16 has a diameter of about 1.5 meters and a thickness of about 50 mm. The shaft 18 has a diameter of about 200–300 mm. The flanges 16 and the shaft 18 are conveniently formed out of mild steel, or out of a surface hardening steel. Each flange 16 has twenty-four circumferentially spaced flail bores 20 provided therein.

Figure 3:
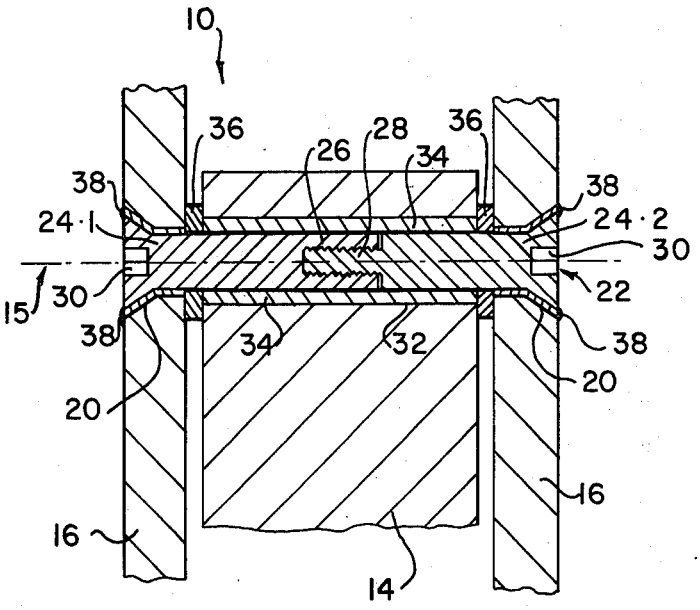
FIG. 3 shows a sectional view, to an enlarged scale, along line III—III of FIG. 2.

Three circumferentially spaced flail members 14 are mounted between each pair of adjacent flanges 16 so that four banks of flail members 14 are provided across the width of the apparatus 10. Each flail member 14 is pivotally mounted in position between a pair of adjacent flanges 16 by means of a pivot pin 22 (as can be seen in particular in FIG. 3). Each flail bore 20 is countersunk, and each pivot pin 22 comprises two complementary sections 24.1 and 24.2 which co-operate to support a flail member pivotally. The section 24.1 has a threaded socket 26, whereas the section 24.2 has a threaded complementary spigot portion 28. Each section 24.1 and 24.2 further has a recess 30 for receiving an Allan-type key.

In use, the sections 24.1 and 24.2 can be inserted into the flail bores 20 from opposed sides, and can then have their spigot and socket 28 and 26 engaged to form a rigid supporting pivot pin 22. The pivot pins 22 can thus be readily inserted into position, and can readily be removed for maintenance or replacement of the flail members 14. As can be seen in particular in FIG. 3, each flail member 14 has a flail bore 32 for receiving a pivot pin 22. Each flail member 14 is supported on its pivot pin 22 via bearing sleeves 34. Each pivot pin 22 further has a pair of spacer rings 36 provided thereon to maintain a required minimum clearance of about 4 to 10 mm between each flail member 14 and the flanges 16 adjacent thereto. Once a flail member 14 has been mounted on a pivot pin 22, the sections 24.1 and 24.2 of each pivot pin 22 may be fixed to the flanges 16 by, for example, spot welds 38. Each flail member 14 is formed out of mild steel or surface hardening steel and has a width of about 250 mm.

Figure 2:
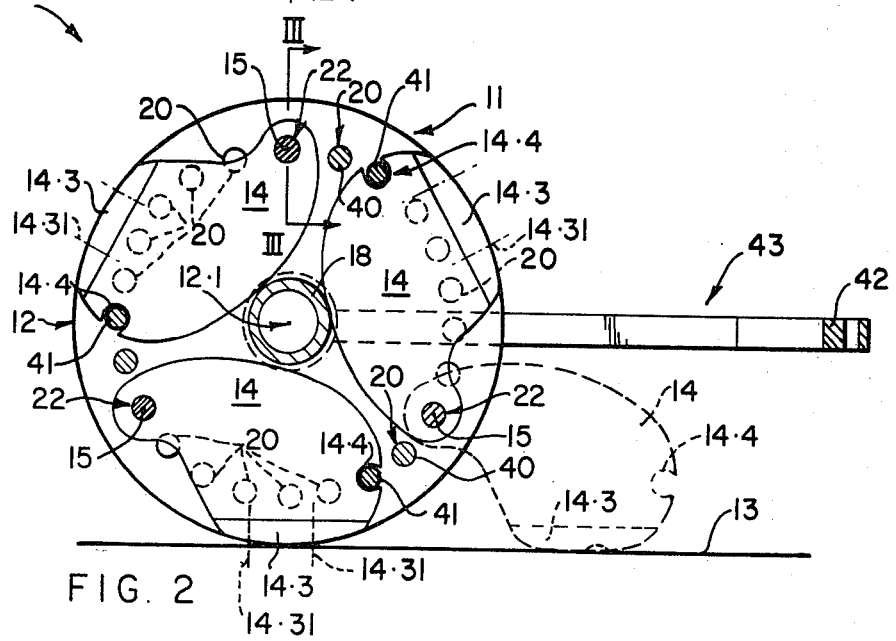
FIG. 2 shows a cross-sectional view along the line II—II of FIG. 1.

As can be seen in particular in FIG. 2 of the drawings, each flail member 14 is shaped to have its mass concentrated near its free end to provide the maximum flailing impact during use. Each flail member 14 has an impact surface 14.1 and an abutment surface 14.2. The impact surface 14.1 is provided by a manganese steel replaceable insert 14.3 seating in a seat in the flail member 14 and secured in position by countersunk set screws having centre lines 14.31. Each impact surface 14.1 is curved to correspond with the curvature of the flanges 16. Each flail member 14 is further shaped so that in its inoperative position, its abutment surface 14.2 abuts the shaft 18.

The arrangement of the flanges 16 and shaft 18 is such that the adjacent pairs of flanges 16 define flail recesses 17 for housing the flail members 14 when they are in their inoperative, retracted positions. The mounting and shaping of the flail members 14 are such that when they are in their inoperative, retracted positions, the abutment surfaces 14.2 will abut the shaft 18, whereas the impact surfaces 14.1 are in alignment with and lie within the peripheral surfaces of the flanges 16 when viewed axially.

The roller 10 also includes stop means in the form of stop bars 40 which are mounted in appropriate flail bores 20 to limit the displacement arcs of the flail members 14 thereby preventing a flail member 14 from entering into the flail recess of a leading flail member 14 during use. The stop bars 40 may conveniently correspond in diameter with the pivot pins 22.

The roller 10 further has a frame 43 in which the roller assembly is rotatably mounted. It also has a drawbar 42 for connecting the apparatus 10 to a suitable draft vehicle. The roller assembly is mounted on a shaft 18 which is rotatably mounted in bearings 44 supported by the frame 43.

With the dimensions and materials of the roller 10 as indicated, it is expected that the mass of the roller 10 will be about 20 tonnes.

It will be noted that the flail members 14 in the four separate banks, are suitably staggered for balancing purposes and for encouraging the roller 10 to follow a generally straight path during use.

In the embodiment illustrated in the drawings, the mounting of the flail members 14 is such that, during use, a flail member 14 in the righthand outer bank will become operative, followed by a flail member in the lefthand outer bank, followed by a flail member in the righthand inner bank, followed by a flail member in lefthand inner bank, and so on.

In use, when the apparatus 10 is drawn at a relatively low speed of, say, 3–4 kilometers per hour, the effects of centrifugal force will be neglible. Therefore, as the roller assembly 11 rolls, the flail members will, fall forwardly under the action of gravity alone, and be pivotally displaced out of the body portion 12 for their impact surfaces 14.1 to impart downward blows cyclically on a surface 13 being compacted.

However, as the rolling speed of the roller 10 increases so centrifugal force increases and causes the flail members 14 to become pivotally displaced out of their recesses 17 towards their operative positions.

Thus, during use, each flail member will be caused to impart an impact blow on a surface being treated under the effect of the centrifugal force as well as under the effect of gravity.

When the roller is to be taken from one work place to another then it may be necessary to render the flail members inoperative while travelling between such work places. This may be done by lock bars 41 engaging with suitably positioned flail bores 20 and with recesses 14.4 in the flail members 14.

In preliminary experiments conducted by applicant, it was found that once the roller 10 was being propelled at a sufficient speed in relation to its mass and in relation to the type of surface being treated, the body portion 12 tended to be raised above the surface being compacted, so that the roller 10 was supported during use solely by the impact surfaces 14.1 in contact with the surface being impacted.

It follows therefore that in such a case the mass of the body portion 12 will contribute to the compaction impact of the impact surfaces 14.1. If it is found that the body portion 12 is being maintained above the surface being compacted, the mass of the roller 10 may be increased, or may be added to by providing means 43.1 to receive suitable ballast 43.2 on the frame 43.

It is an advantage of the embodiment of the invention as illustrated in the drawings, that an effective and robust compaction apparatus is provided for the impact compaction of surfaces and for breaking up concrete paving and road surfaces, when required.

It is a further advantage of the embodiment of the invention as illustrated in the drawings, that since the body portion 12 is of circular cross section, the roller 10 will not present the type of resistance to displacement which would be presented by compaction rollers of non-circular section. The embodiment provides the further advantage that it can be propelled at relatively low speeds where reliance is placed only on the gravitational effects of the flail members 14, and can also be propelled at relatively higher speeds where both gravitational and centrifugal forces contribute to the flailing effect and thus the impact compaction force of the flail members 14.

As each flail member 14 comes into contact with a surface being compacted, the compaction force will be directed primarily in the downward direction. Without wishing to be bound by theory, applicant believes that each impact will not provide a substantial retarding effect on the roller 10 and thus on a draught vehicle for the roller 10, since continued motion of the roller 10 will cause each flail member in turn, after impact, to be rolled into the recess within the body portion thereby limiting its resistance effect on forward displacement of the roller 10.

The embodiment of the invention as illustrated in the drawings, provides the further advantage that because the flail members 14 exercise a flailing action at a radius far greater than the radius of the body portion 12 during use, the compaction impact of the flail members 14 would tend to be substantially greater than they would be at lesser radii.

From preliminary experiments conducted by applicant, applicant believes that the roller 10 as illustrated in the drawings, will tend to be less destructive insofar as draught vehicles are concerned, than are compaction rollers of non-circular section. In addition, greater impact forces can be generated and relatively lower capacity draught vehicles can be employed for drawing the roller 10 than in the case of compaction rollers of non-circular section and of equivalent mass.

In an embodiment of the invention, where a plurality of axially spaced banks of flail members are provided, the body portion may be divided into a plurality of axially spaced sections, with each section supporting one or more banks of flail members. In this embodiment of the invention, by selecting a desired number of sections and associating them together, a roller having a required width can readily be provided. Further, in this embodiment of the invention, the roller may include an axle for connection to a drawbar assembly, and each section may have a bore for rotatably receiving the axle, so that the sections can be rotatably supported on the axle via suitable bearings.

Thus by simply selecting an axle of an appropriate length, a desired number of sections can be mounted on the axle. The sections may be permanently or removably coupled together so that they will be rotated as a unit during use. If desired, the sections may be mounted on the axle so that at least some sections can rotate independently thereby facilitating turning of the apparatus during use. Each section may therefore comprise two or more axially spaced flanges which are mounted on a hollow shaft for receiving the axle, with adjacent pairs of flanges having the flail members mounted between them.

The invention may broadly be seen as a method of imparting impact blows to a surface 13 over which a roller 10 is being rolled, the method including the steps of permitting a flail member 14 pivotally connected to a roller body portion 12 cyclically in every revolution of the roller as it rolls to extend forwardly beyond the roller profile and cyclically to be retracted into the roller profile during every such revolution of the roller as it rolls, and of permitting the flail member during each forward projection to impart an impact blow under the action of gravity to the surface over which the roller is being rolled.

The method may include the further step of increasing the speed of the rolling of the roller 10 to a value such that the impact blow is imparted also under the action of centrifugal force.

I claim:

1. An impact roller for applying blows cyclically to a surface over which it is rolling, which comprises a roller assembly adapted to roll along a surface, and which includes a roller body portion comprising a plurality of roller sub-units mounted in series axial relationship on an axle, each roller subunit comprising a pair of axially spaced flanges and at least one flail member having an impact surface, the flail member being pivotally connected between the flanges at a region remote from the impact surface about an axis parallel to the roller assembly rolling axis, the sub-units being mounted to be independently rotatable relative to each other about the axis of the axle, and the flail members being adapted in use while the roller assembly is rolling, to have the impact surfaces impart cyclic downward blows to the surface along which the roller assembly is rolling.

2. An impact roller for applying blows cyclically to a surface over which it is rolling, which comprises a roller assembly adapted to roll along a surface, and which includes a roller body portion; and a plurality of flail members each of which has an impact surface and all of which are pivotally connected remote from their impact surfaces to the roller body portion in symmetrical circumferentially spaced relationship about axes parallel to the roller assembly rolling axis and adapted in use while the roller assembly is rolling, to have the impact surfaces impart cyclic downward blows to the surface along which the roller assembly is rolling; and which includes locking means to lock the flail members to the roller body portion within the profile of the roller assembly when viewed in an axial direction, to permit transfer of the roller from one working zone to another without impact blows during transfer.

3. An impact roller for applying blows cyclically to a surface over which it is rolling, which comprises a roller assembly adapted to roll along a surface, and which includes a roller body portion; and a plurality of flail members each of which has an impact surface and all of which are pivotally connected remote from their impact surfaces to the roller body portion in axially and circumferentially spaced relationship about axes parallel to the roller assembly rolling axis and adapted in use while the roller assembly is rolling, to have the impact surfaces impart cyclic downward blows to the surface along which the roller assembly is rolling; and which includes locking means to lock the flail members to the roller body portion within the profile of the roller assembly when viewed in an axial direction, to permit transfer of the roller from one working zone to another without impact blows during transfer.

4. A roller as claimed in claim 1, claim 2 or claim 3, in which the pivotal axis of each flail member is at least half the roller assembly radius from the roller assembly rolling axis.

5. A roller as claimed in claim 1, claim 2 or claim 3, in which each flail member has a replaceable impact insert providing the impact surface for the flail member.

6. An impact roller for applying blows cyclically to a surface over which it is rolling, which comprises a roller assembly adapted to roll along a surface, and which includes a roller body portion; and at least one flail member within a recess in the roller body portion and having a length greater than the radius of the roller body portion and having an impact surface and which is pivotally connected remote from the impact surface to the roller body portion about an axis parallel to and spaced from the roller assembly rolling axis and adapted in use, while the roller assembly is rolling, to fall forward out of the recess and thereby to have the impact surface impart cyclic downward blows ahead of the roller body portion to the surface along which the roller assembly is rolling, the spacing between the flail member pivotal axis and the roller assembly axis being at least half the radius of the roller assembly.

7. A roller as claimed in claim 6, which includes a plurality of flail members, all pivotally connected to the roller body portion in symmetrical circumferentially spaced relationship about axes parallel to the roller assembly rolling axis.

8. A roller as claimed in claim 6, which includes a plurality of flail members, all pivotally connected to the roller body portion in axially and circumferentially spaced relationship about axes parallel to the roller assembly rolling axis.

9. A roller as claimed in claim 7 or claim 8, which includes locking means to lock the flail members to the roller body portion within the profile of the roller assembly when viewed in an axial direction, to permit transfer of the roller from one working zone to another without impact blows during transfer.

10. A roller as claimed in claim 6, in which the roller assembly comprises a plurality of roller sub-units mounted in series axial relationship on an axle, each roller sub-unit comprising a pair of axially spaced flanges and at least one flail member pivotally connected between the flanges about an axis parallel to the roller assembly rolling axis.

11. A roller as claimed in claim 10, in which the sub-units are mounted to be independently rotatable relative to each other about the axis of the axle.

* * * * *